US005971341A

United States Patent [19]

Pfister

[11] Patent Number: 5,971,341

[45] Date of Patent: Oct. 26, 1999

[54] ADJUSTABLE LEG SYSTEM

[76] Inventor: Joel W. Pfister, 4967 Kensington Gate, Shorewood, Minn. 55331

[21] Appl. No.: 08/964,996

[22] Filed: Nov. 5, 1997

[51] Int. Cl.[6] ..... F16M 11/00

[52] U.S. Cl. ..... 248/411; 248/188.5

[58] Field of Search ..... 248/404, 410, 248/411, 412, 918, 118.1, 118.2, 118.5

[56] References Cited

U.S. PATENT DOCUMENTS

| | | | |
|---|---|---|---|
| 2,495,674 | 1/1950 | Lewis | 248/410 |
| 3,893,730 | 7/1975 | Homier et al. | 248/410 X |
| 3,999,492 | 12/1976 | Emrick | 248/411 X |
| 4,010,926 | 3/1977 | Carnahan | 248/411 |
| 4,023,649 | 5/1977 | Wood | 248/188.2 X |
| 4,314,591 | 2/1982 | Pierrat | 248/410 X |
| 4,667,918 | 5/1987 | Page | 248/418 |
| 5,106,043 | 4/1992 | Solomon | 248/410 X |
| 5,224,681 | 7/1993 | Lundstrom | 248/410 |
| 5,356,100 | 10/1994 | Bookwalter et al. | 248/188.5 X |
| 5,575,448 | 11/1996 | Battocchio | 248/410 |
| 5,634,537 | 6/1997 | Thorn | 248/418 X |

*Primary Examiner*—Derek J. Berger
*Attorney, Agent, or Firm*—Hugh D. Jaeger

[57] ABSTRACT

An adjustable leg system incorporating an inner tube assembly which readily and easily positions vertically in a surrounding and coaxially aligned outer tube assembly. The inner tube assembly is suspended concentrically to and on a counterbalance assembly contained partially within and concentric with the outer tube assembly. An actuating handle at the upper end of the positionable inner tube assembly operates a pushrod assembly which operates and influences a plurality of flat springs, one end of which engages between the inner tube assembly and the outer tube assembly to vertically lock the adjustable leg system in a triangulation configuration. During locking by the flat springs, glides spaced apart at about 120° on the exterior surface of the inner tube assembly are brought to bear against the interior surface of the outer tube assembly. The flat springs are deformed by movement of the actuating handle to relieve intimate forced spring contact transmitted across the springs to allow for unimpeded vertical leg positioning.

9 Claims, 15 Drawing Sheets

ADJUSTABLE LEG SYSTEM

CROSS REFERENCES TO CO-PENDING APPLICATIONS

None.

BACKGROUND OF THE INVENTION

1. Field of the Invention

The present invention is for an adjustable leg system, and more particularly, pertains to an adjustable leg system having an actuating handle which effects a three point locking process during vertical adjustment of the leg. The adjustable leg system can be incorporated for use in mounting and adjustment of tables, chairs, stools, pedestals, computer equipment and any other adjustable supports.

2. Description of the Prior Art

Prior art adjustable leg systems have presented a paradox in that if a leg system operated freely in a vertical fashion, then there was a degree of wiggle or instability between the major members; and if tolerances were closely set to eliminate wiggle or instability, then the leg system would not operate freely in a vertical direction. Further, smooth and wiggle-free and stable vertical adjustment could be accomplished, but at the expense of well machined interior surfaces, which proved uneconomical to produce. Prior art devices have also exhibited one or more control adjustments or knobs at various heights and positions along the vertical support members, which proved to be unsightly, difficult to use, in the way, or obtrusive in that clothes or other objects could be caught on or be interfered with by the protuberances. Often, ergonomically pleasing adjustable leg systems were not easily obtainable. Prior art devices often utilize minimal adjustmental contact, whereby one has to manually tighten a knob to accomplish single point contact and whereby vertical slippage could readily occur if not tightened securely by a strong person.

Clearly what is needed is an adjustable leg system that is easily, simply and readily adjusted, preferably by one hand, that is ergonomically pleasing, that has a minimum of operating controls, that is economical to fabricate, and that has a method of locking incorporating more than one or two locking points, surfaces or the like. The present invention provides such an adjustable leg system.

SUMMARY OF THE INVENTION

The general purpose of the present invention is to provide an adjustable leg system incorporating an inner tube assembly which readily and easily positions vertically in a surrounding and coaxially aligned outer tube assembly. The inner tube assembly is suspended concentrically to and on a counterbalance assembly contained partially within and concentric with the outer tube assembly. An actuating handle at the upper end of the positionable inner tube assembly operates a pushrod assembly which operates and influences a plurality of flat springs, one end of which engages between the inner tube assembly and the outer tube assembly to vertically lock the adjustable leg system in a triangulation configuration, although such is not to be construed as limiting of the present invention. During locking by the flat springs, glides spaced at about 120° on the exterior surface of the inner tube assembly are brought to bear against the interior of the outer tube assembly. The flat springs are deformed by movement of the actuating handle to relieve intimate forced spring contact transmitted across the springs to allow for unimpeded vertical leg positioning.

According to one embodiment of the present invention, there is provided an adjustable leg system including a base support; an outer tube assembly secured to and extending vertically from the base support; a counterbalance assembly aligned within and concentric to the outer tube assembly and including a square tube, a concentrically mounted gas spring, and an attached suspension yoke; an inner tube assembly coaxially aligned over and about the counterbalance assembly and coaxially aligned with and partially within the outer tube assembly and including a plate/spring assembly, a plurality of glides, a pushrod assembly and an actuating handle; and a top mounting bracket.

One significant aspect and feature of the present invention is an adjustable leg system which operates with only one control, an actuating handle.

Another significant aspect and feature of the present invention is an adjustable leg system which has a three point lock construction.

Yet another significant aspect and feature of the present invention is an adjustable leg system which can incorporate economical and commonly found electro-weld tubing.

Still another significant aspect and feature of the present invention is an adjustable leg system which incorporates stacks of flat springs which form one member of the three point lock construction.

An additional significant aspect and feature of the present invention is an adjustable leg system which incorporates a breakaway system so that a twisting force does not have to be applied to the adjustable leg system.

A further significant aspect and feature of the present invention is an adjustable leg system which provides for loosening or breaking loose of gas tube O-rings, which may have become engaged on the gas tube due to inactivity, by initial movement of the actuating handle.

A still further significant aspect and feature of the present invention is an adjustable leg system which is economical to build and requires no special components.

A yet further significant aspect and feature of the present invention is an adjustable leg system which can be operated by one hand, or possibly two hands, for lowering of the leg.

Having thus summarized the present invention and set forth significant aspects and features thereof, it is one object hereof to provide an adjustable leg system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
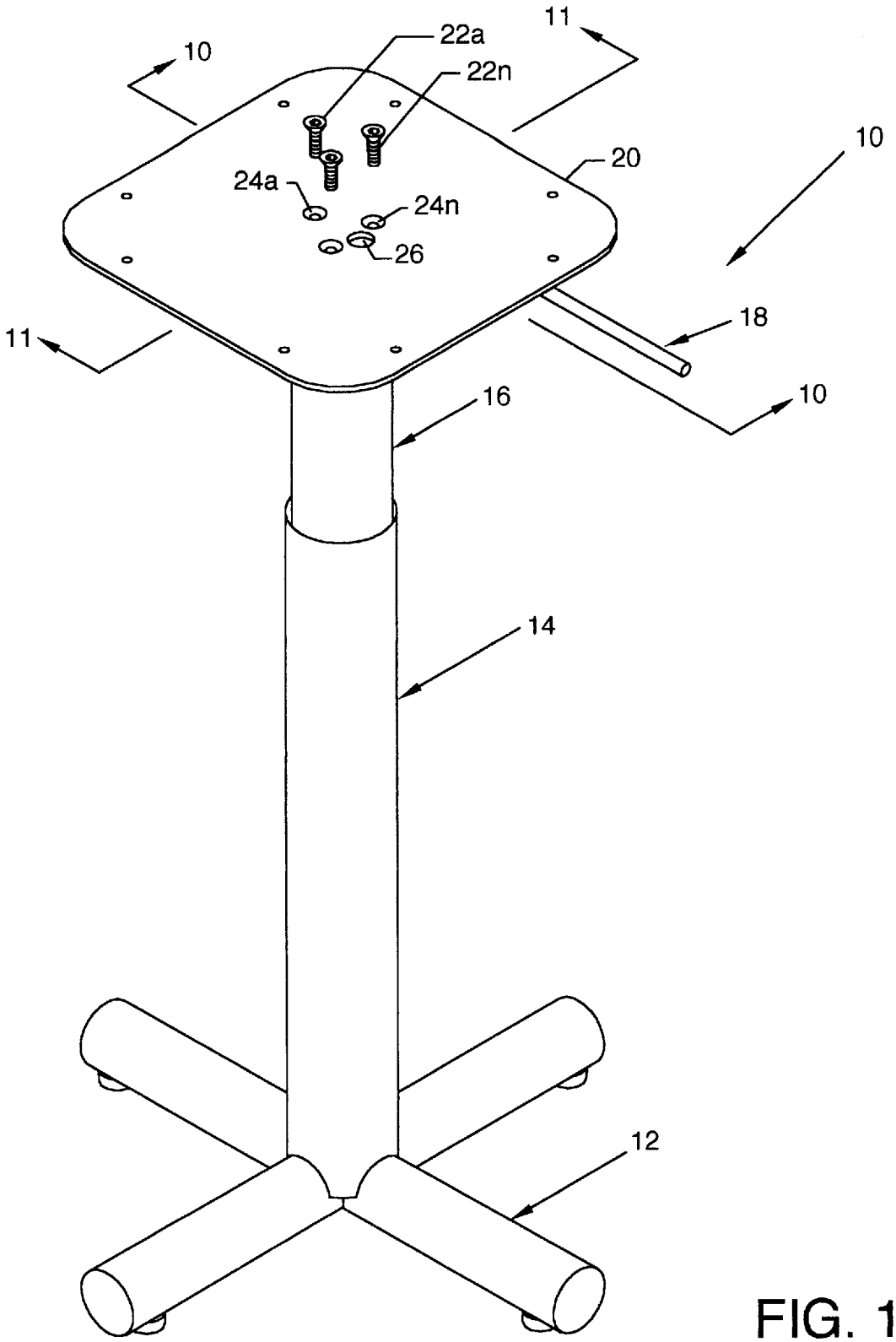
FIG. 1 illustrates an isometric view of an adjustable leg system, the present invention.

FIG. 1 illustrates an isometric view of an adjustable leg system 10, such as used for the support of a table top or other object such as a seat, chair or bench. Although the adjustable leg system 10 and teachings of the present invention are described for adjustably supporting a table top or other similar object, the components can also be used to adjustably support or position any other desired object. The outwardly visible components illustrated in FIG. 1 include a base support 12, shown as composed of intersecting tubes but which could assume a variety of other configurations such as a mounting plate, a screw-in base or the like, a vertically oriented outer tube assembly 14 secured to and extending upwardly from the base support 12, a vertically aligned inner tube assembly 16 coaxially aligned to and partially contained within the outer tube assembly 14, an actuating handle 18 which secures to the upper region of the inner tube assembly 16, and a mounting bracket 20 which appropriately secures to the top of the inner tube assembly 16 such as by a plurality of screws 22*a*–22*n* which align through holes 24*a*–24*n*. An access hole 26 is provided in the mounting bracket 20 for internal mechanical adjustment, as later described in detail.

Figure 2:
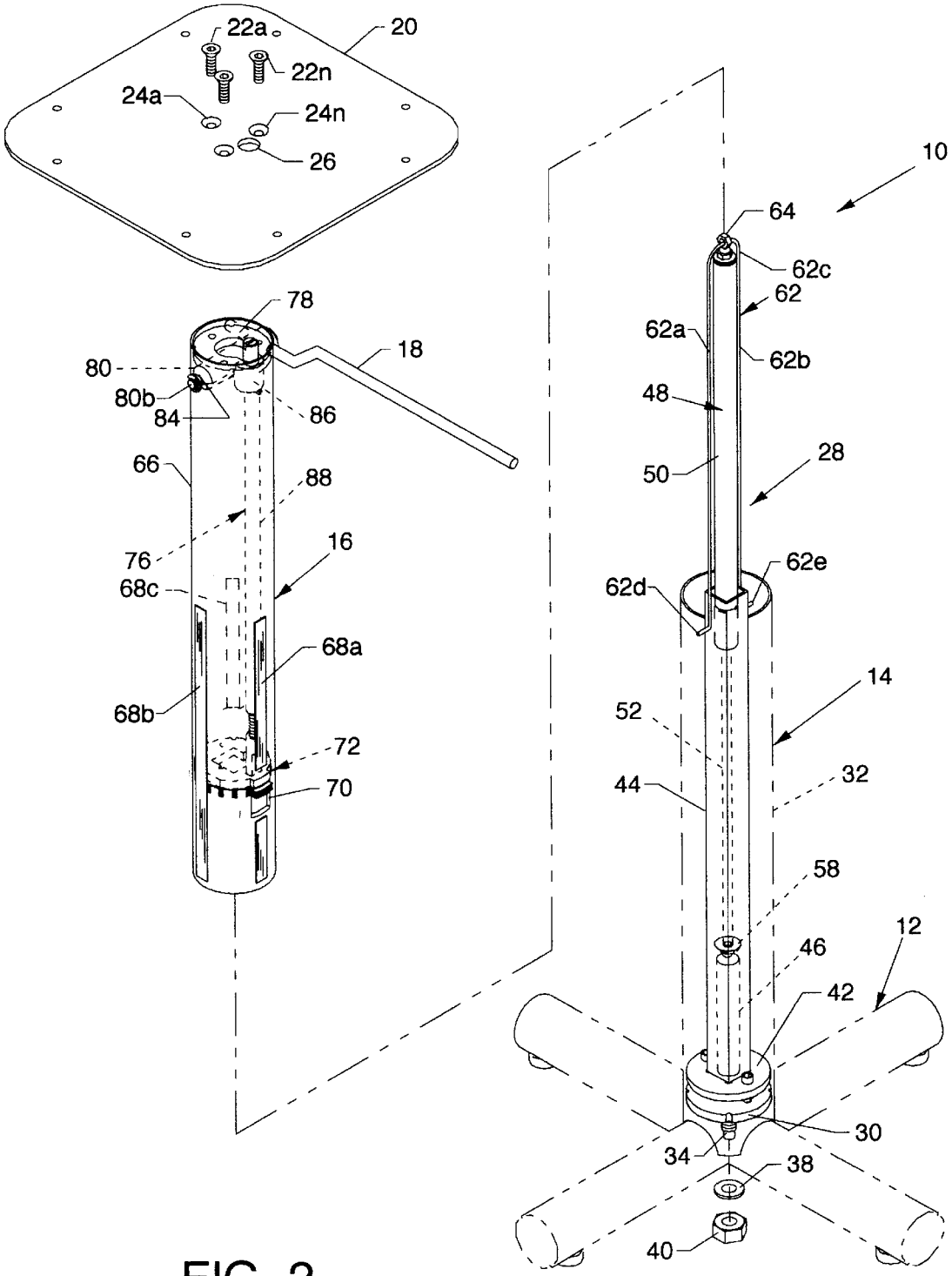
FIG. 2 illustrates an exploded isometric view of the adjustable leg system.

FIG. 2 illustrates an exploded isometric view of the adjustable leg system 10. A counterbalance assembly 28, which in general is located central to the present invention, is shown having its lower half coaxially aligned to and partially contained within the outer tube assembly 14. The upper half of the counterbalance assembly 28 coaxially aligns to and is partially contained within the inner tube assembly 16. The vertical geometry of the counterbalance 28 is adjustably changed with respect to the outer tube assembly 14 and the inner tube assembly 16, as later described.

Figure 3:
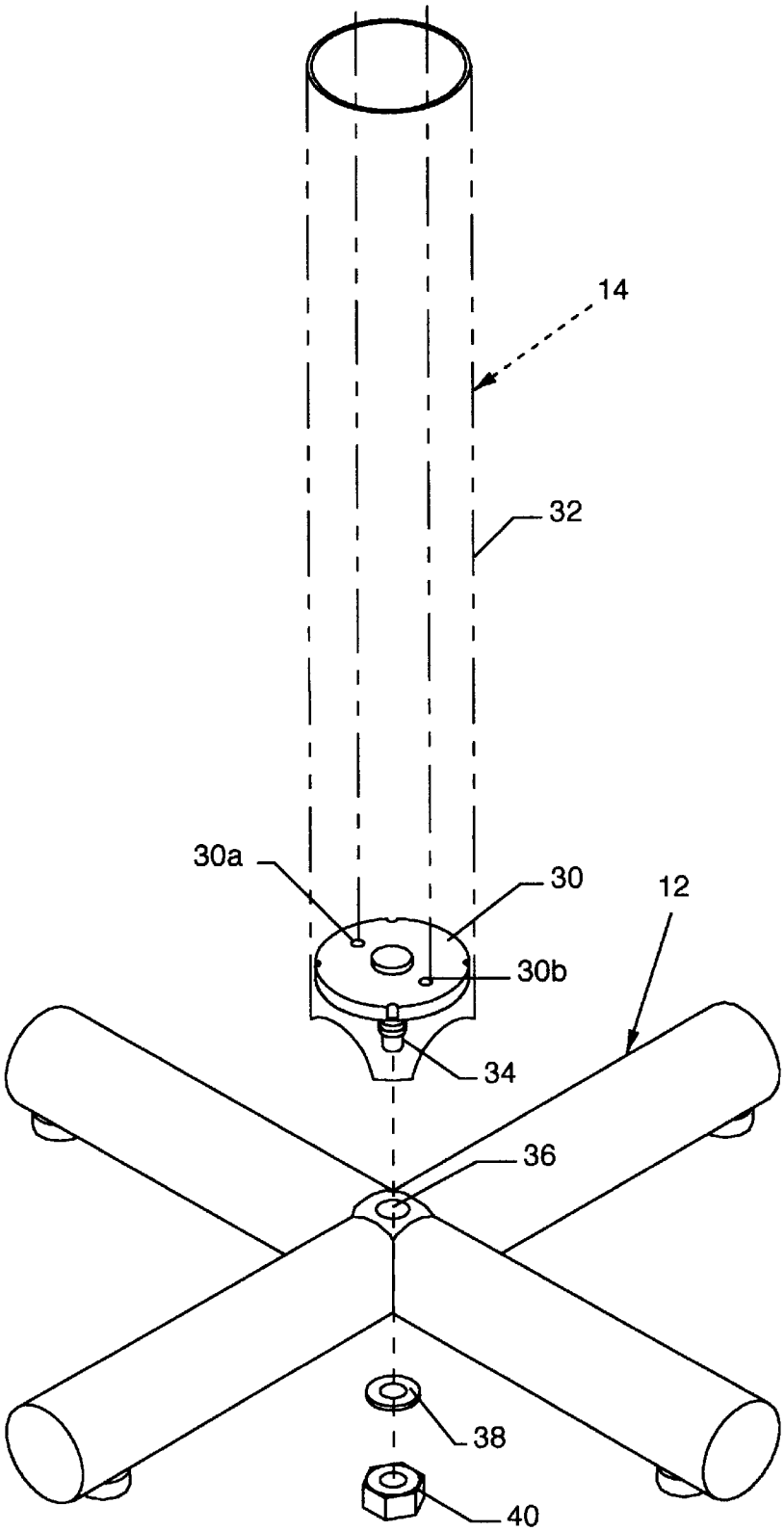
FIG. 3 illustrates an exploded isometric view of the outer tube assembly and base support.

FIG. 3 illustrates an exploded isometric view of the outer tube assembly 14 and the base support 12. Especially referenced in FIG. 3 is a circular plate 30 which secures, such as by welding or other suitable means, to the inner wall of an outer tube 32 which is part of the outer tube assembly 14. A mounting stud 34 secures to the center of the circular plate 30 and extends through a hole 36 in the base support 12 to engage a washer 38 and nut 40. The outer tube assembly 14 is secured to the base support 12 by the mounting stud 34, the washer 38 and the nut 40. Also especially referenced in FIG. 3 are opposing recesses 30*a* and 30*b* in the circular plate 30 which are incorporated in a breakaway feature which also prevents overtorquing about the vertical axis of the adjustable leg system 10. Further reference is made to the breakaway feature and operation thereof in FIG. 10, as later described.

Figure 4:
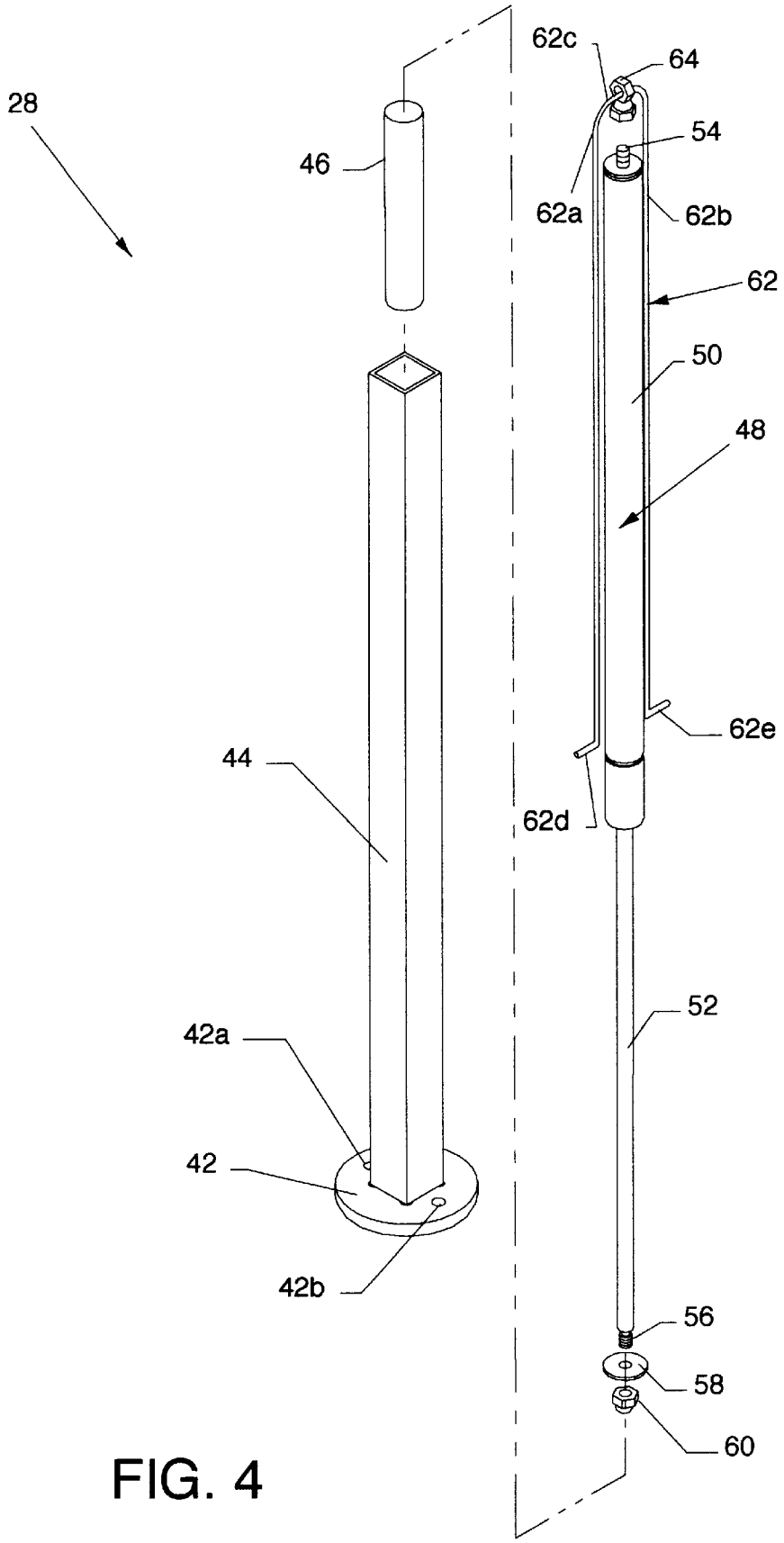
FIG. 4 illustrates an exploded isometric view of the counterbalance assembly.

FIG. 4 illustrates an exploded isometric view of the counterbalance assembly 28. The counterbalance assembly 28 includes a base plate 42, which is circular, a square tube 44 secured to circular base plate 42 such as by welding or other suitable means and extending vertically therefrom, a spacer rod 46 aligned to the bottom interior portion of the square tube 44, a gas spring 48 having a cylinder 50, and an extension rod 52. A stud 54 is located at the top of the cylinder 50 and a threaded surface 56 is included at the lower end of the extension rod 52. A centering spacer 58 secures to the threaded surface 56 of the extension rod 52 by a castellated nut 60. The centering spacer 58 centrally locates the extension rod 52 within the lower portion of the square tube 44. The diameter of the cylinder 50 serves to coaxially align the cylinder 50 to the interior of the square tube 44. A suspension yoke 62 attaches to the stud 54 at the top of the cylinder 50 by a screw-on pivot bracket 64. The suspension yoke 62 is of heavy wire or like construction having opposed vertical legs 62*a* and 62*b*, a curved portion 62*c* connecting legs 62*a* and 62*b*, and opposed horizontal tabs 62*d* and 62*e* extending horizontally from the lower ends of the vertical legs 62*a* and 62*b*, respectively. The outer tube assembly 14, gas spring 48, suspension yoke 62, and associated members serve to support the inner tube assembly 16. The circular base plate 42 has opposing holes 42*a* and 42*b* which align with the opposing recesses 30*a* and 30*b* in the circular plate 30 of FIG. 3. The breakaway feature is further illustrated in FIG. 10.

With reference again to FIG. 2, the inner tube assembly 16 is shown to include a plurality of components or assemblies mounted to an inner tube 66. The diameter of the inner tube 66 is just slightly less than that of the outer tube 32 into which it engages. Vertically aligned glides 68*a*, 68*b* and 68*c* of a polymer, metal or other such suitable material align at about 120° intervals about the lower portion of the inner tube 66, as illustrated. Glide 68*a* is segmented and aligns to a rectangular hole 70 distant from the bottom edge of the inner tube 66. A plate/spring assembly 72 aligns and is welded between the top of the rectangular hole 70 and a weld hole 74 (shown in FIG. 5). The plate/spring assembly 72 is configured, as later described in detail, to be supportingly accommodated by the gas spring 48 and the suspension yoke 62 to also support the inner tube assembly 16 and mounting bracket 20. The plate/spring assembly 72 includes a plurality of various circular flat springs, as later described in detail, which function to assist in locking the inner tube assembly 16 in a vertical relationship with respect to the outer tube assembly 14, to overcome initial internal resistance encountered during operation of the gas spring 48, and to assist in at rest positions of the actuating handle 18. A pushrod assembly 76, also illustrated in FIG. 5, extends from the plate/spring assembly 72 to a configured mounting plate 78 welded to the upper edge of the inner tube 66. The pushrod assembly 76 is actuated by the actuating handle 18 to position tabbed circular flat springs 114*a*–114*n* in the plate/spring assembly 72, as described in relation to FIGS. 8–15 for locking or unlocking of the inner tube assembly 16 with respect to the outer tube assembly 14, and also to overcome initial internal resistance encountered during operation of the gas spring 48, as well as to assist in at rest positions of the actuating handle 18. The actuating handle 18 secures to a transversely mounted cam 80 appropriately mounted between holes 82 (see FIG. 5) and 84 near the top edge of the inner tube 66. An integral pivot 80*b*, having a radius smaller than the cam 80, and at one end of the cam 80, aligns in hole 84; and the portion of the cam 80 to one side of the actuating handle aligns in hole 82. The cam 80 positions against and operates a cylindrically shaped mechanical pusher 86 located at the upper portion of and being part of the pushrod assembly 76 to provide motion of the pushrod assembly 76 for operation of the plate/spring assembly 72.

Figure 5:
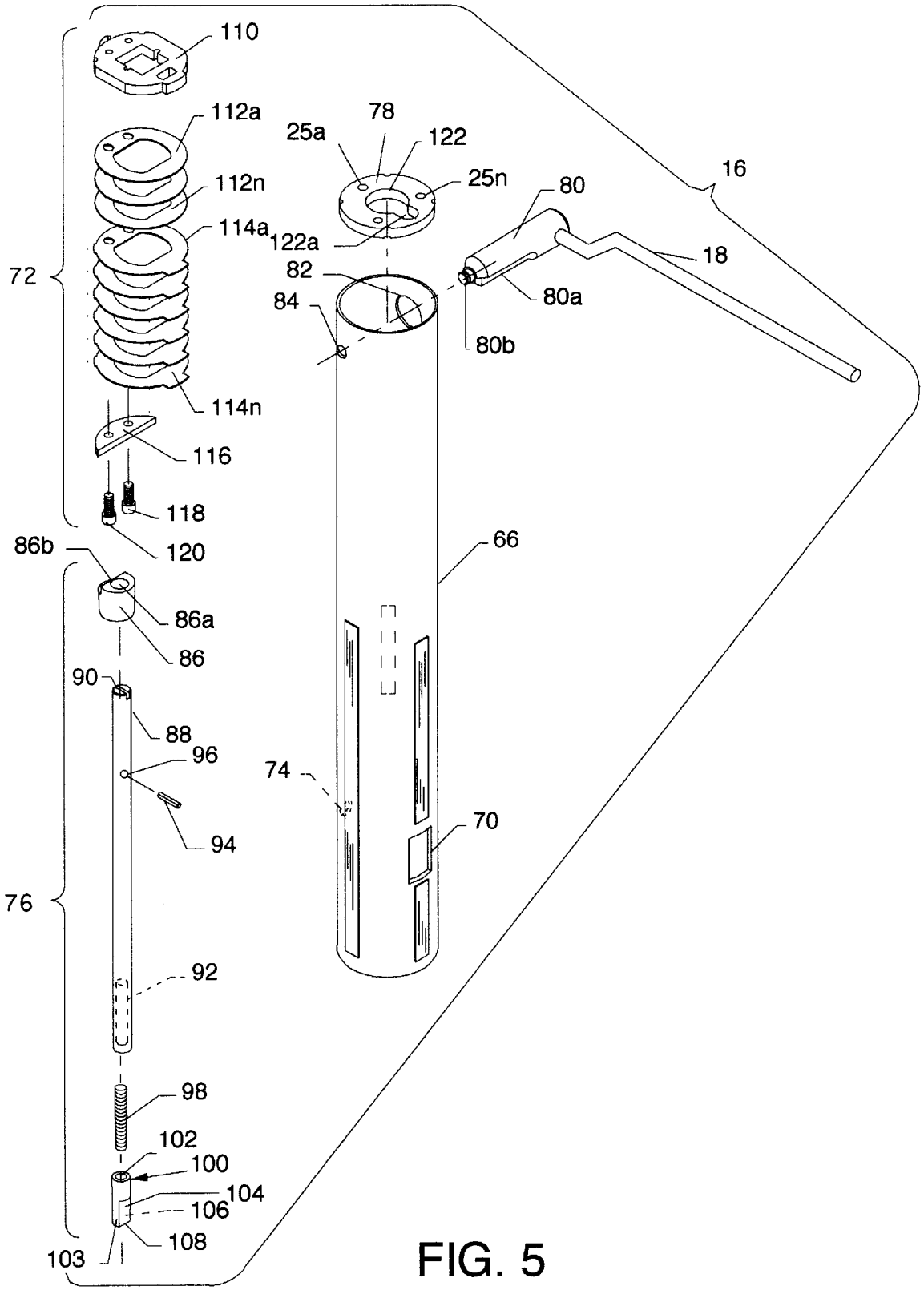
FIG. 5 illustrates an exploded isometric view of the inner tube assembly.

FIG. 5 illustrates an exploded isometric view of the inner tube assembly 16. The pushrod assembly 76 includes an upper rod 88 having an adjustment slot 90 at its upper end, an internally threaded hole 92 at its lower end, and a stop pin 94 and pin mounting hole 96 near its upper end; a threaded rod 98 engaging threaded hole 92; a lower rod 100 having an internally threaded hole 102 which engages one end of the threaded rod 98, a tip 103 having like and opposing flat surfaces 104 and 106, and a bottom impingement surface 108; and the mechanical pusher 86. The mechanical pusher 86 is vertically aligned, cylindrically shaped, and includes a bore 86*a* and a horizontally aligned groove 86*b* along one side. The bore 86*a* of the mechanical pusher 86 aligns over and about the upper portion of the upper rod 88 and positions against the stop pin 94.

The substantially circularly shaped plate/spring assembly 72 is formed of a plurality of aligned, stacked components. A mounting plate 110 constitutes the top component of the plate/spring assembly 72 and it is followed in succession by a plurality of stacked circular flat springs 112*a*–112*n*, a plurality of stacked tabbed circular flat springs 114*a*–114*n*, a clamping plate 116, and machine screws 118 and 120. The machine screws 118 and 120 pass through holes in the clamping plate 116, the plurality of tabbed circular flat springs 114*a*–114*n*, and the plurality of circular flat springs 112*a*–112*n*, and secure in threaded mounting holes in the mounting plate 110. The plurality of circular flat springs 112*a*–112*n*, the plurality of tabbed circular flat springs 114*a*–114*n*, and the mounting plate 110 all have centrally located openings for accommodation of the gas spring 48, the suspension yoke 62, the upper end of the square tube 44, and other associated components which pass therethrough. The clamping plate 116, the plurality of circular flat springs 112*a*–112*n*, the plurality of tabbed circular flat springs 114*a*–114*n*, and the mounting plate 110 are further described below. Mounting plate 78 is also illustrated and includes threaded holes 25*a*–25*n* for accommodation of screws 22*a*–22*n* for mounting of the mounting bracket 20 shown in FIG. 1. A hole 122 with a slotted portion 122*a* is located central to the mounting plate 78. The slotted portion 122*a* of the hole 122 accommodates the upper portion of the upper rod 88 of the pushrod assembly 76 and allows for accessibility to the adjustment slot 90. Also shown in FIG. 5 is a horizontally aligned groove 80*a* in cam 80 which engages the mechanical pusher 86.

Figure 6:
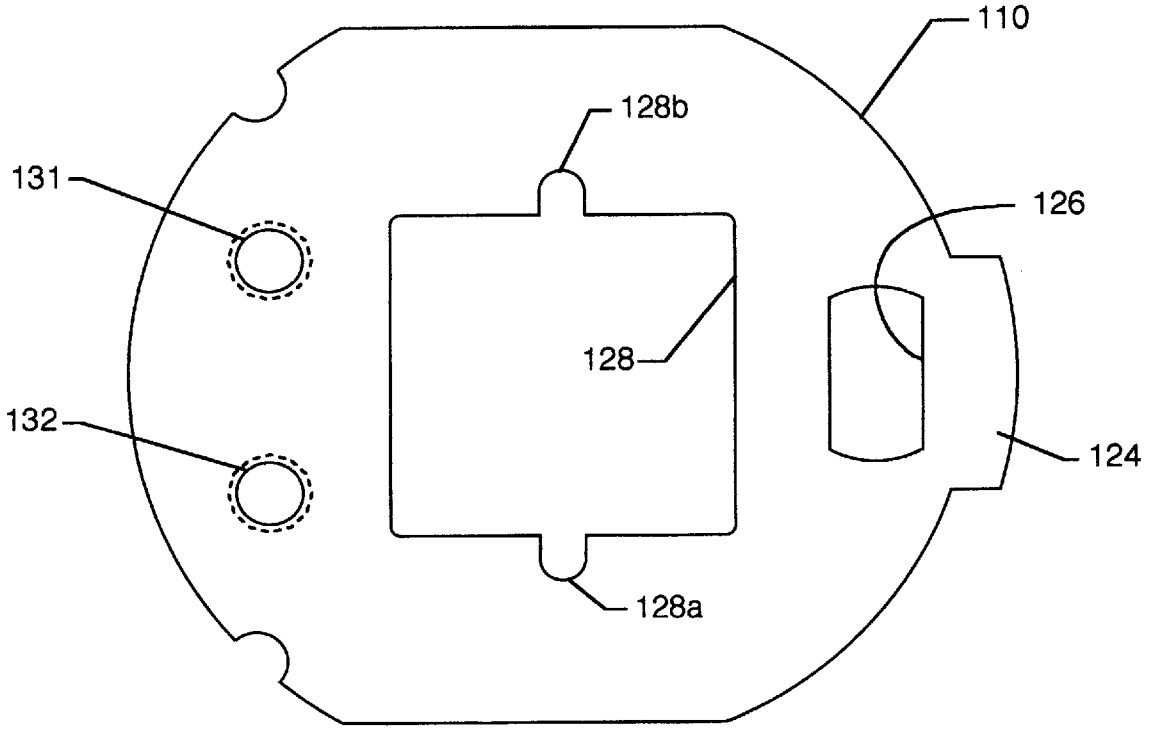
FIG. 6 illustrates a top view of the mounting plate.

FIG. 6 illustrates a top view of the mounting plate 110. The mounting plate 110 includes a welding tab 124, a substantially rectangular opening 126 for accommodation of the tip 103 of the lower rod 100, a centrally located larger square opening 128, notches 128*a* and 128*b* at opposing sides of the square opening 128, and threaded holes 131 and 132 for the accommodation of the machine screws 118 and 120. In general, the square opening 128 accommodates the gas spring 48 and the upper portion of the square tube 44; and the notches 128*a* and 128*b* accommodate the legs 62*a* and 62*b* of the suspension yoke 62.

Figure 7:
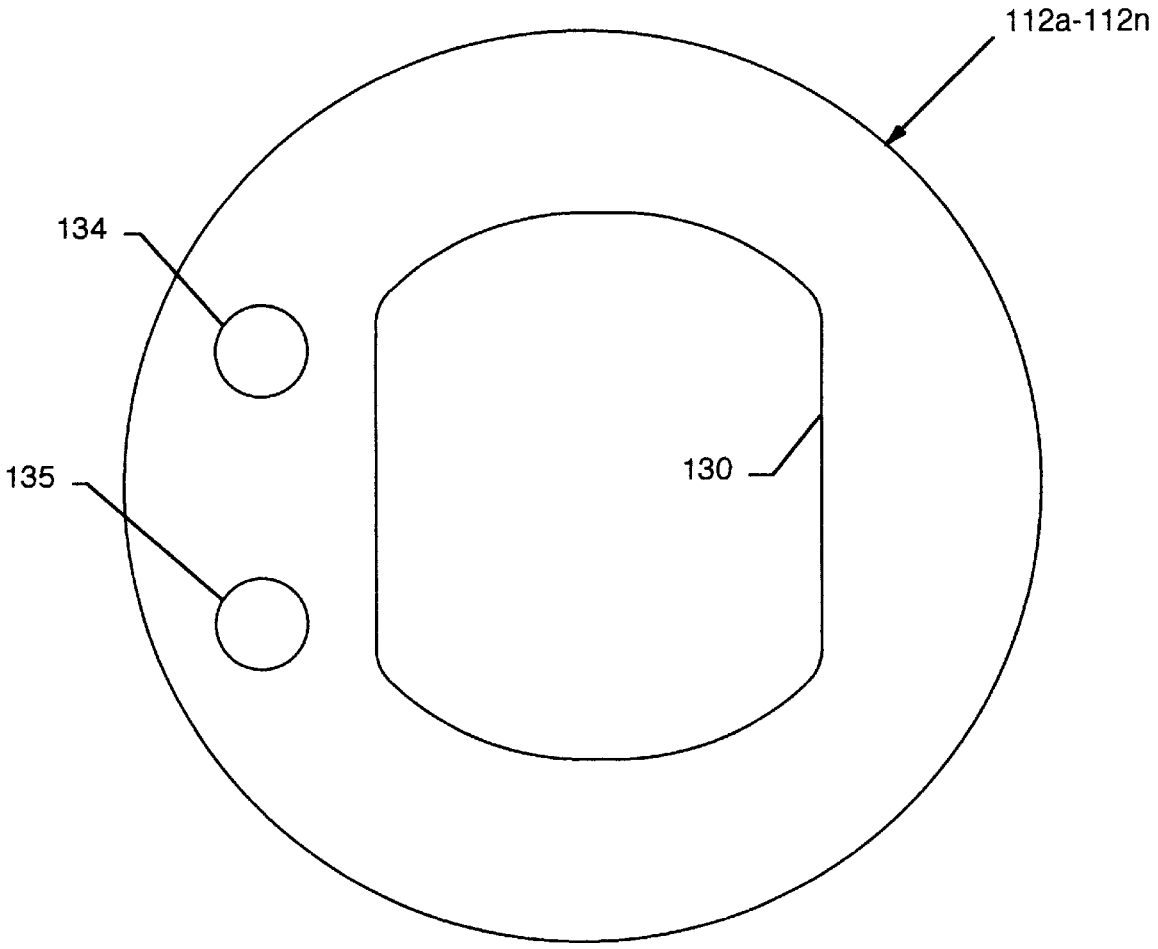
FIG. 7 illustrates a top view of identically constructed circular flat springs.

FIG. 7 illustrates a top view of the identically constructed circular flat springs 112*a*–112*n*. A centrally located opening 130 accommodates the gas spring 48, the upper portion of the square tube 44, and the legs 62*a* and 62*b* of the suspension yoke 62; and body holes 134 and 135 accommodate the machine screws 118 and 120.

Figure 8:
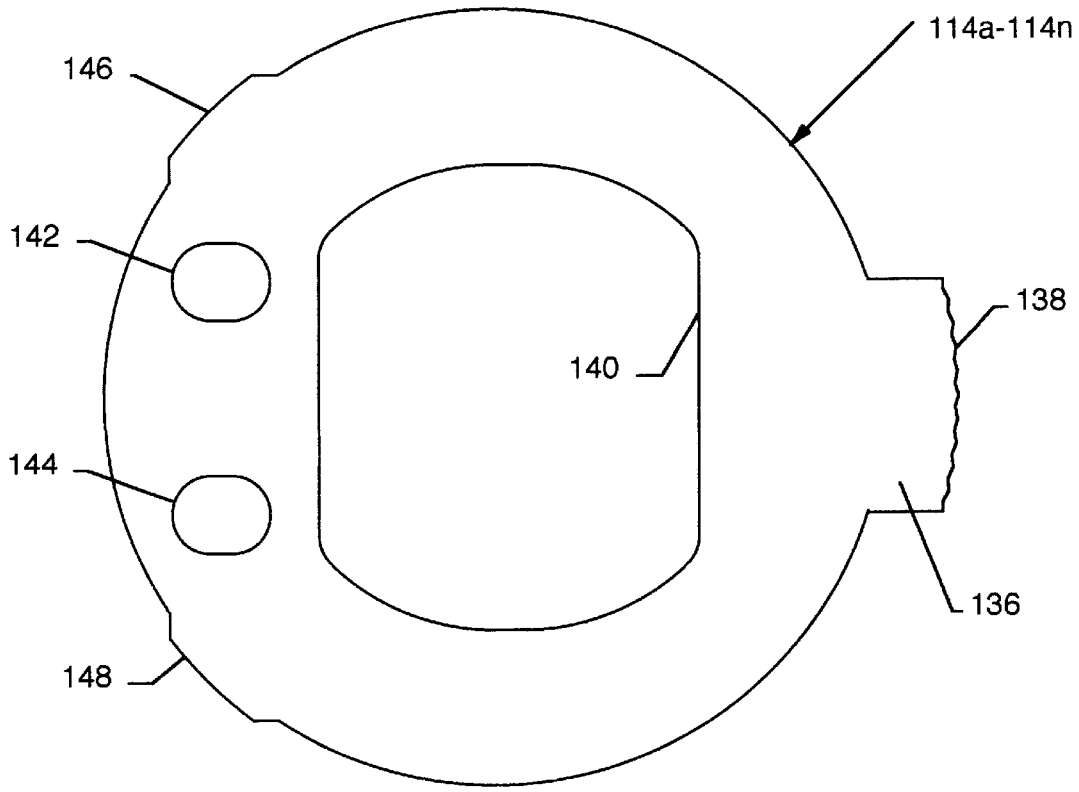
FIG. 8 illustrates a top view of identically constructed tabbed circular flat springs.

FIG. 8 illustrates a top view of the identically constructed tabbed circular flat springs 114*a*–114*n*. A tab 136 having a serrated edge 138 extends from the substantially circular structure. A centrally located opening 140 accommodates the gas spring 48, the upper portion of the square tube 44, and the legs 62*a* and 62*b* of the suspension yoke 62; and elongated body holes 142 and 144 adjustively receive the machine screws 118 and 120. Spacer tabs 146 and 148 extend from the structure to facilitate initial alignment in concert with the elongated body holes 142 and 144.

Figure 9:
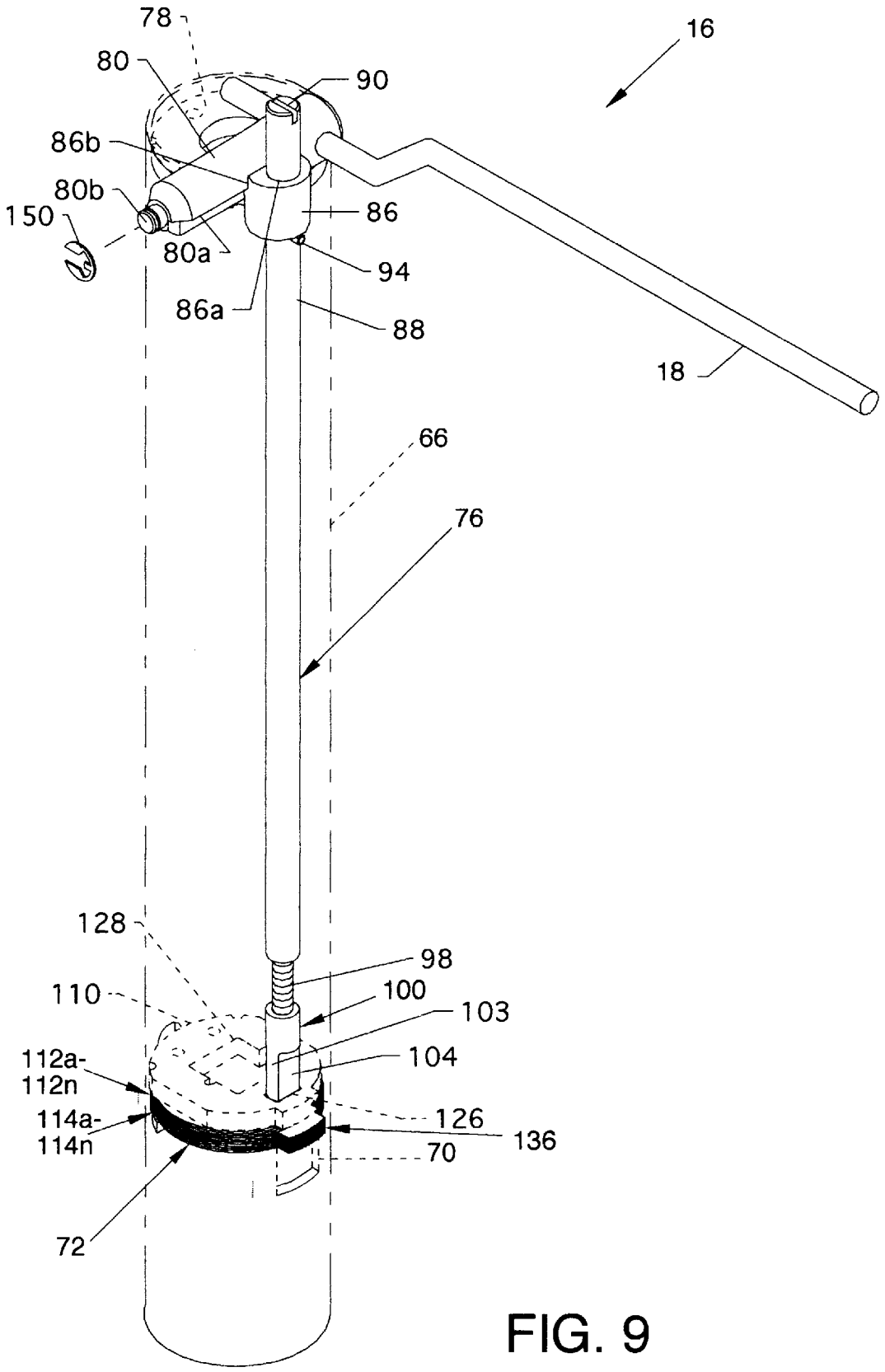
FIG. 9 illustrates an isometric view of the pushrod assembly engaging a cam as superimposed on the assembled inner tube assembly.

FIG. 9 illustrates an isometric view of the pushrod assembly 76 engaging cam 80 as superimposed on the assembled inner tube assembly 16, illustrated in dashed lines, to illustrate initial assembly without adjustment of the pushrod assembly 76. Actuating handle 18 is shown in the position for locking of the inner tube assembly 16 to the outer tube assembly 14. The tip 103 of the lower rod 100 loosely engages and is guided by the rectangular opening 126 in the mounting plate 110, and is in contact with the uppermost circular flat spring 112*a* for subsequent communication to the stacked circular flat springs 112*b*–112*n* and tabbed circular flat springs 114*a*–114*n*. In this illustration, the inner tube assembly 16 is not shown inserted into the outer tube assembly 14 and as such the stacked circular flat springs 112*a*–112*n* and tabbed circular flat springs 114*a*–114*n*, in concert, are essentially unflexed, thereby exhibiting non-flexed spring structures. It is noted that the combined tabs 136 of the combined tabbed circular flat springs 114*a*–114*n* extend outwardly beyond the annular circumference of the inner tube 66. This outward extension of the combined tabs 136 is instrumental in locking communication, and locking of the inner tube assembly 16 to the outer tube assembly 14, as described in further detail below. The adjustment slot 90 at the top of the upper rod 88 is incorporated to adjust the length of the pushrod assembly 76. For purposes of this illustration, a few turns of the upper rod 88 causes slight flexing of the stacked circular flat springs 112*a*–112*n* and tabbed circular flat springs 114*a*–114*n*, and in return, utilizes the spring qualities of the stacked circular flat springs 112*a*–112*n* and tabbed circular flat springs 114*a*–114*n* to exert a force along the pushrod assembly 76 which forces the actuating handle 18, with communication through the engaged mechanical pusher 86 and the cam 80, to the horizontal and "engaged" locking position, whereby the combined tabs 136 extend outwardly beyond the annular circumference of the inner tube 66. A spring clip 150 is provided for engagement over and about the cam pivot 80*b*.

Figure 10:
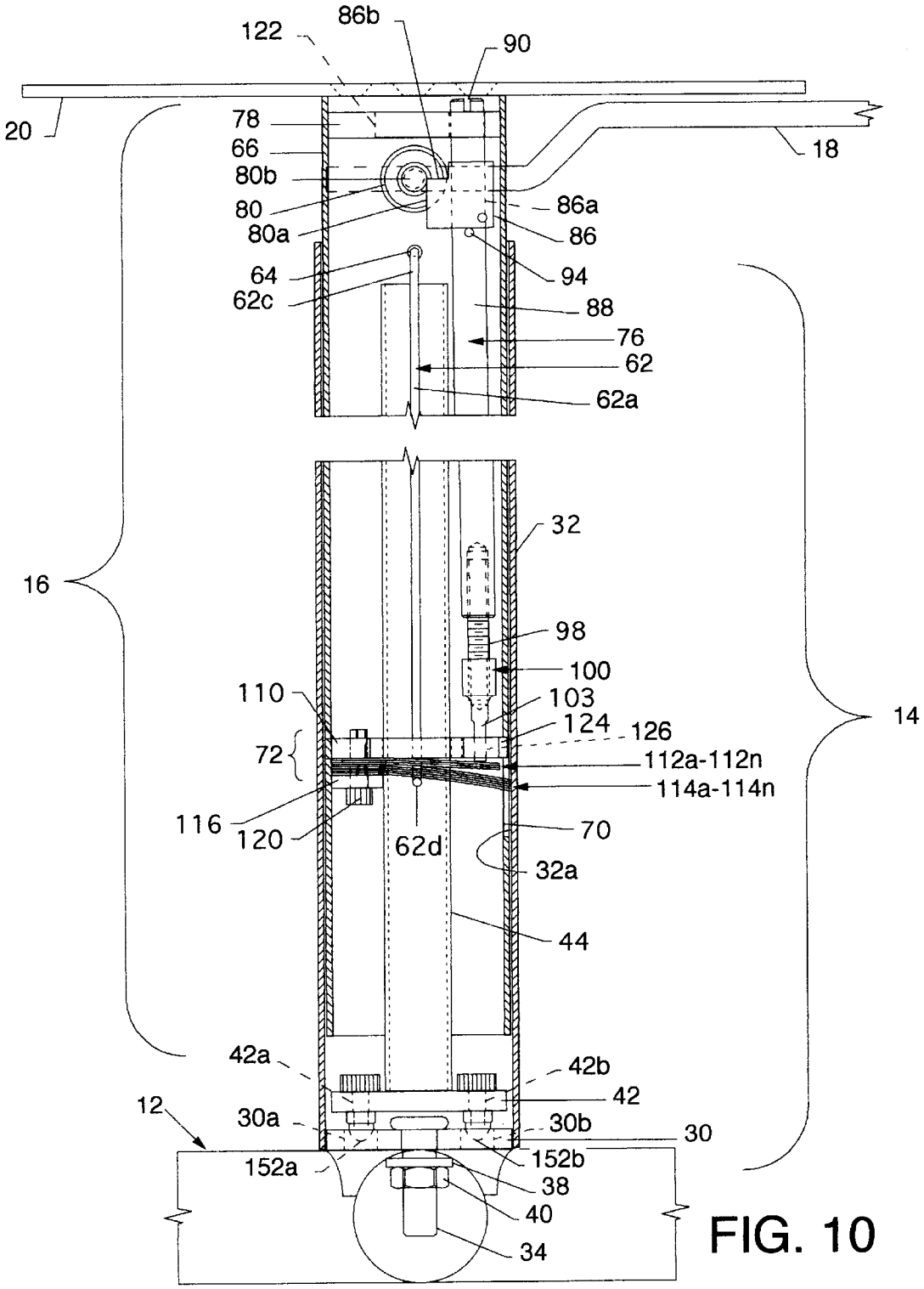
FIG. 10 illustrates a cross sectional view of the adjustable leg system along line 10—10 of FIG. 1.

FIG. 10 illustrates a cross sectional view of the adjustable leg system 10 along line 10—10 of FIG. 1. This view illustrates the actuating handle 18 in the up and locked position, whereby the pushrod assembly 76 has been sufficiently lengthened to cause flexing of the circular flat springs 112*a*–112*n*, thereby causing an upward force to be applied to the tip 103, and thus the entire pushrod assembly 76 causes the actuating handle 18 to be in the static parked position. The plurality of tabbed circular flat springs 114*a*–114*n* are in flexed high force engagement with the interior surface 32*a* of the outer tube 32. This is known as the "engaged" position, whereby the inner tube assembly 16 is locked to the outer tube assembly 14. The engaged position is a three point lock process, which is described later in detail in connection with FIGS. 12 and 13. Also illustrated are the components of the breakaway feature. Protuberances 152*a* and 152*b*, preferably having semi-spherical or semi-elliptical or other such suitable shapes, mount to and extend through holes 42*a* and 42*b*, which can assume like-shaped surfaces corresponding to protuberances 152*a* and 152*b*, in the circular base plate 42 and mutually engage in recesses 30*a* and 30*b* in the circular plate 30. This mutual engagement is provided to mutually reference the outer tube assembly 14 and the inner tube assembly 16 to each other prior to three point locking of the outer tube assembly 14 and the inner tube assembly 16, the locking process which is later described in detail. Spring force provided by the counterbalance assembly 28, as transmitted vertically, forces the protuberances 152*a* and 152*b* into recesses 30*a* and 30*b* in the circular plate 30. Should excessive torsional twisting force be applied about the vertical axis of the adjustable leg system 10, the protuberances 152*a* and 152*b* will disengage from recesses 30*a* and 30*b*.

Figure 11:
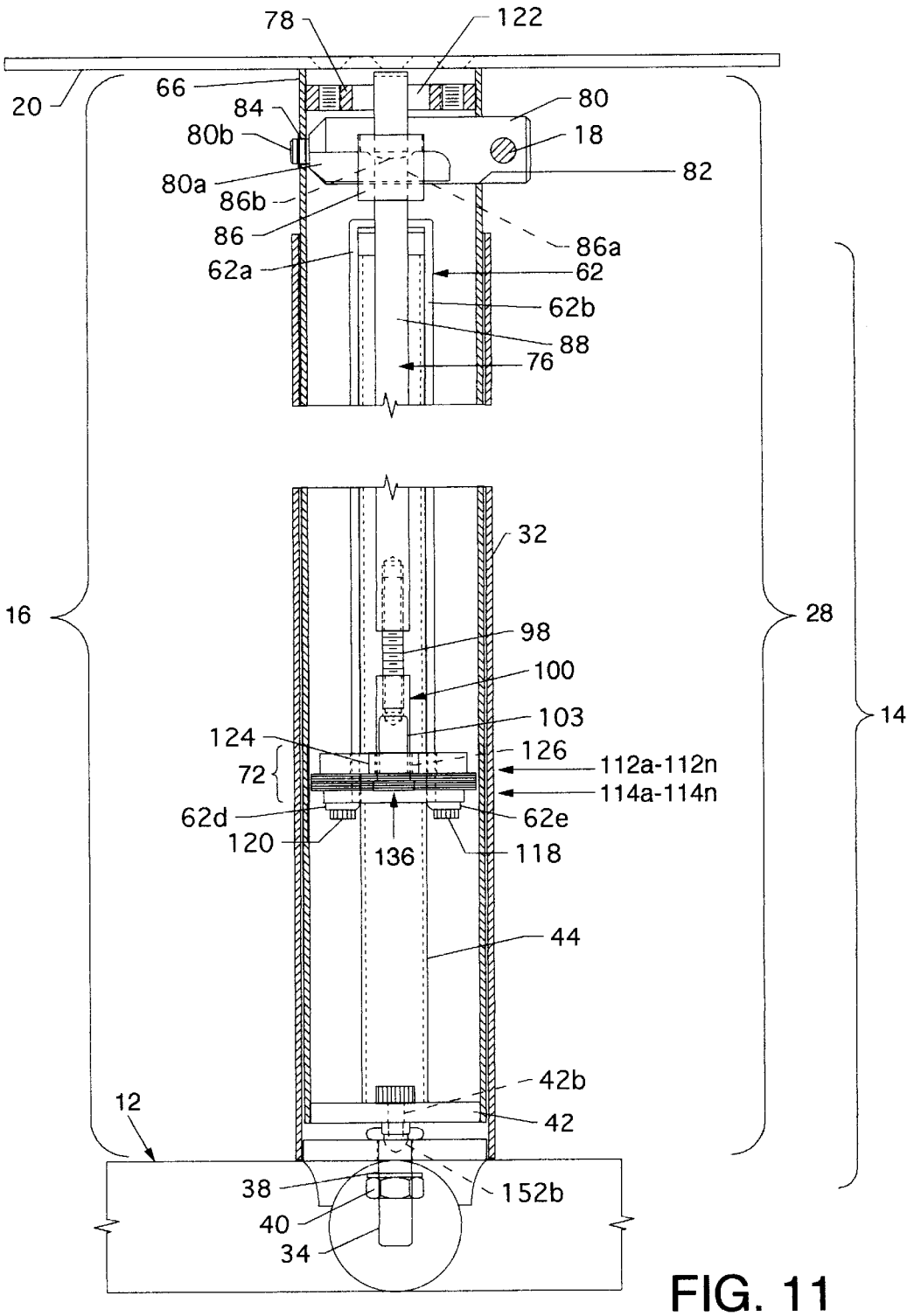
FIG. 11 illustrates a cross sectional view of the adjustable leg system along line 11—11 of FIG. 1.

FIG. 11 illustrates a cross sectional view of the adjustable leg system 10 along line 11—11 of FIG. 1, like a front view, where all numerals correspond to those elements previously described. Stacked circular flat springs 112*a*–112*n* and tabbed circular flat springs 114*a*–114*n* are shown in an unflexed state for the purpose of brevity and clarity. Particularly illustrated in this figure is the suspension yoke 62 which suspends the inner tube assembly 16 on the counterbalance assembly 28. Suspension yoke legs 62*a* and 62*b* extend through the center of the plate/spring assembly 72 in accommodation by the notches 128*a* and 128*b* in the mounting plate 110, and tabs 62*d* and 62*e* extend horizontally across the bottom of the plate/spring assembly 72 to support the plate/spring assembly 72 and the attached inner tube assembly 16.

MODE OF OPERATION

FIGS. 12–15, with additional reference to the preceding figures, best illustrate the mode of operation.

Figure 12:
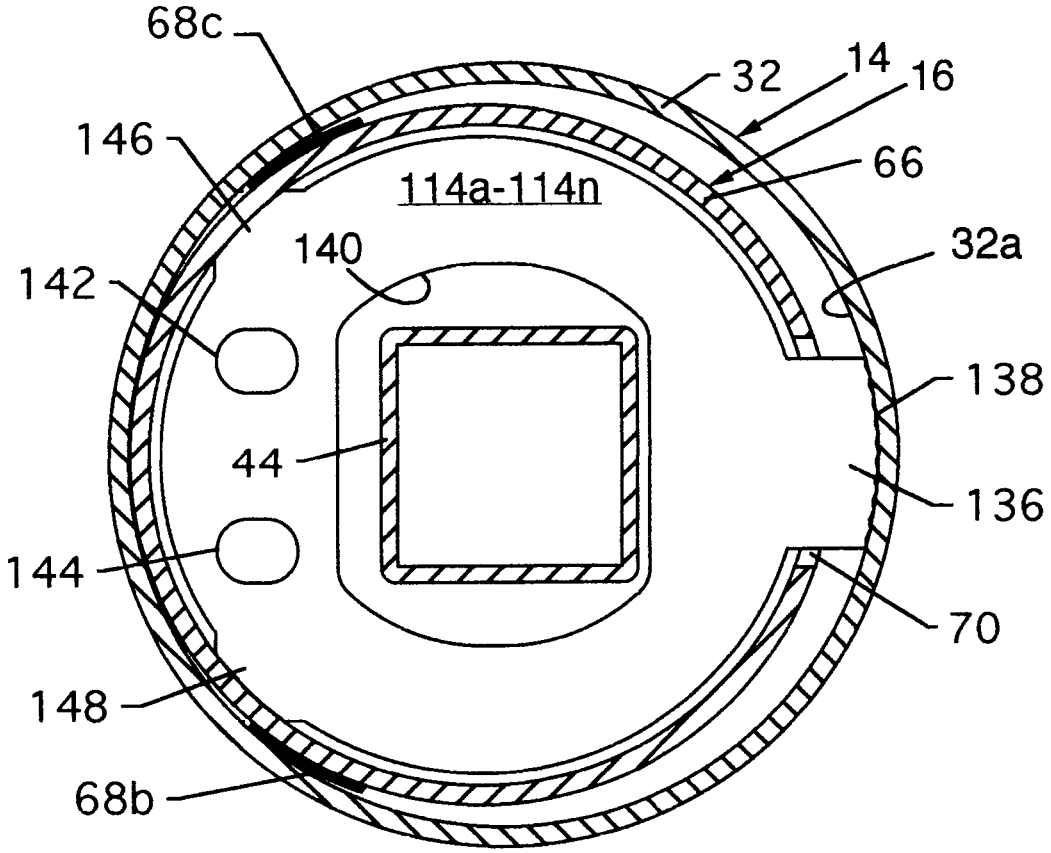
FIG. 12 illustrates a cross sectional view along line 12—12 of FIG. 13.
Figure 13:
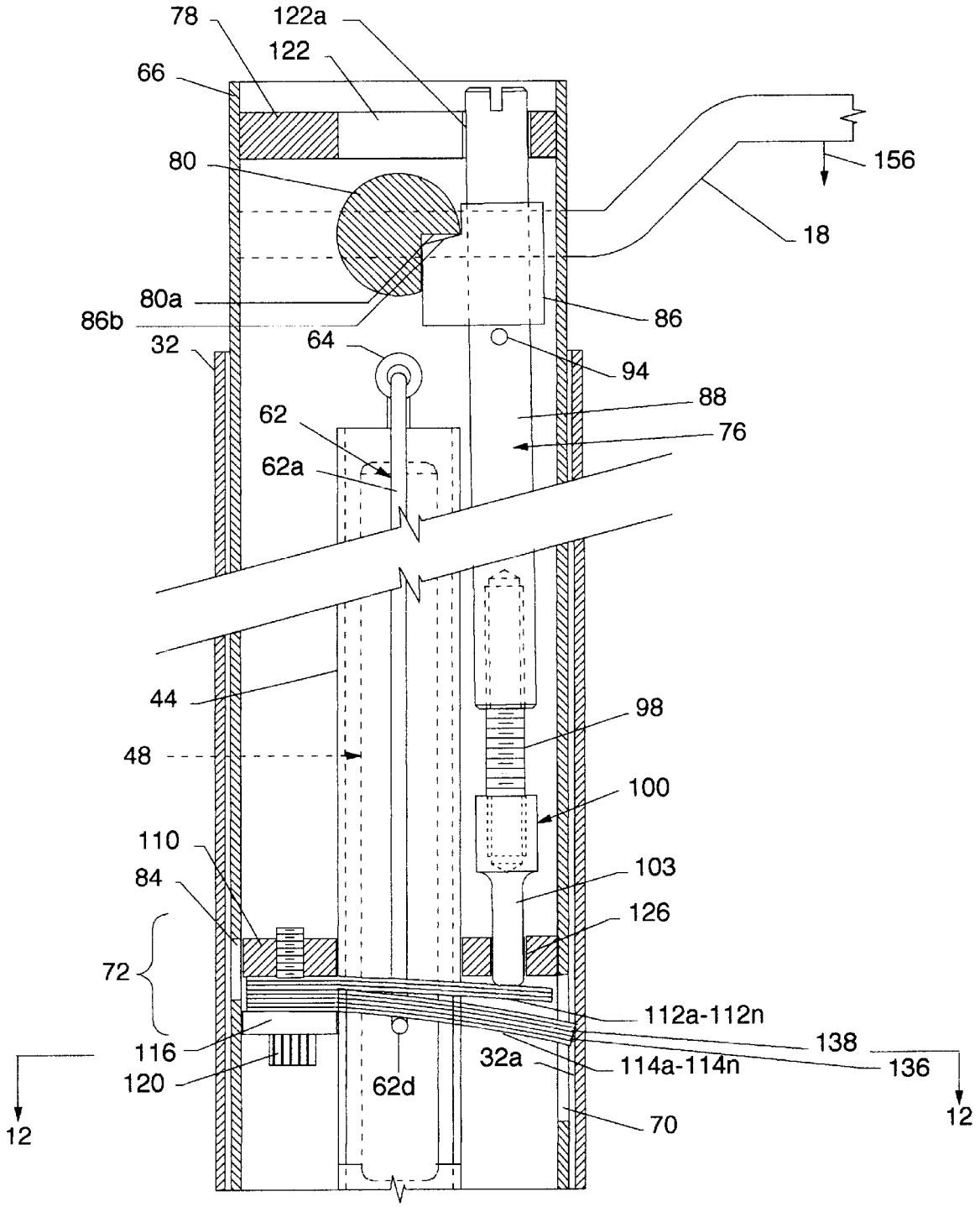
FIG. 13 illustrates a vertical cross section of the adjustable leg system illustrating an "engaged" mode.

FIG. 12 illustrates a cross sectional view taken along line 12—12 of FIG. 13. Shown in particular in FIG. 12 is the "engaged" mode where components of the outer tube assembly 14 are locked to components of the inner tube assembly 16 by the three point lock process. As previously described, the tabbed circular flat springs 114*a*–114*n* are in flexed high force engagement with the interior surface 32*a* of the outer tube 32. This is known as the "engaged" mode position, whereby the inner tube assembly 16 is locked to the outer tube assembly 14. The tabbed circular flat springs 114*a*–114*n* exhibit a force outwardly towards and against the adjacent interior surface 32*a* of the outer tube 32, thereby forcing the inner tube 66 in an opposite direction toward the inner surface of the outer tube 32, and against the glides 68*b* and 68*c*. Glides 68*b* and 68*c* and the tabs 136 provide for the three points of the three point lock process where outward force is distributed across the glides 68*b*, 68*c* and the tabs 136.

FIG. 13 illustrates a vertical cross section of the adjustable leg system 10 showing the "engaged" mode. In this "engaged" mode, the tabbed circular flat springs 114*a*–114*n* are in flexed high force engagement with the interior surface 32*a* of the outer tube 32 where components of the outer tube assembly 14 are locked to components of the inner tube assembly 16 by the three point lock process. This view illustrates the actuating handle 18 in the up and static parked position whereby the pushrod assembly 76 has been sufficiently lengthened to cause flexing of the circular flat springs 112*a*–112*n*, thereby causing an upward force to be applied to the tip 103, and thus the entire pushrod assembly 76 causes the actuating handle 18 to be in the static parked position. As the actuating handle 18 is initially moved in the direction of arrow 156, the groove 80*a* of the cam 80 operates against the groove 86*b* of the mechanical pusher 86 to force the upper rod 88 and lower rod 100, which aligns through rectangular opening 126, downwardly against the combined stack of circular flat springs 112*a*–112*n* and tabbed circular flat springs 114*a*–114*n*. Actuation of the pushrod assembly 76 causes several reactions to occur. First, the initial action forces the suspension yoke 62 to be actuated and moved downwardly to break and overcome, by mechanical advantage, any internal O-ring sticking interior to the gas spring 48 and thereby provide for smooth, easy and uninterrupted operation of the system. Second, with further actuation of the actuating handle 18, the tabbed circular flat springs 114*a*–114*n* are removed from intimate forceful contact with the interior surface 32*a* of the outer tube 32, thus providing for a "disengaged" mode, as described with relation to FIGS. 14 and 15.

Figure 14:
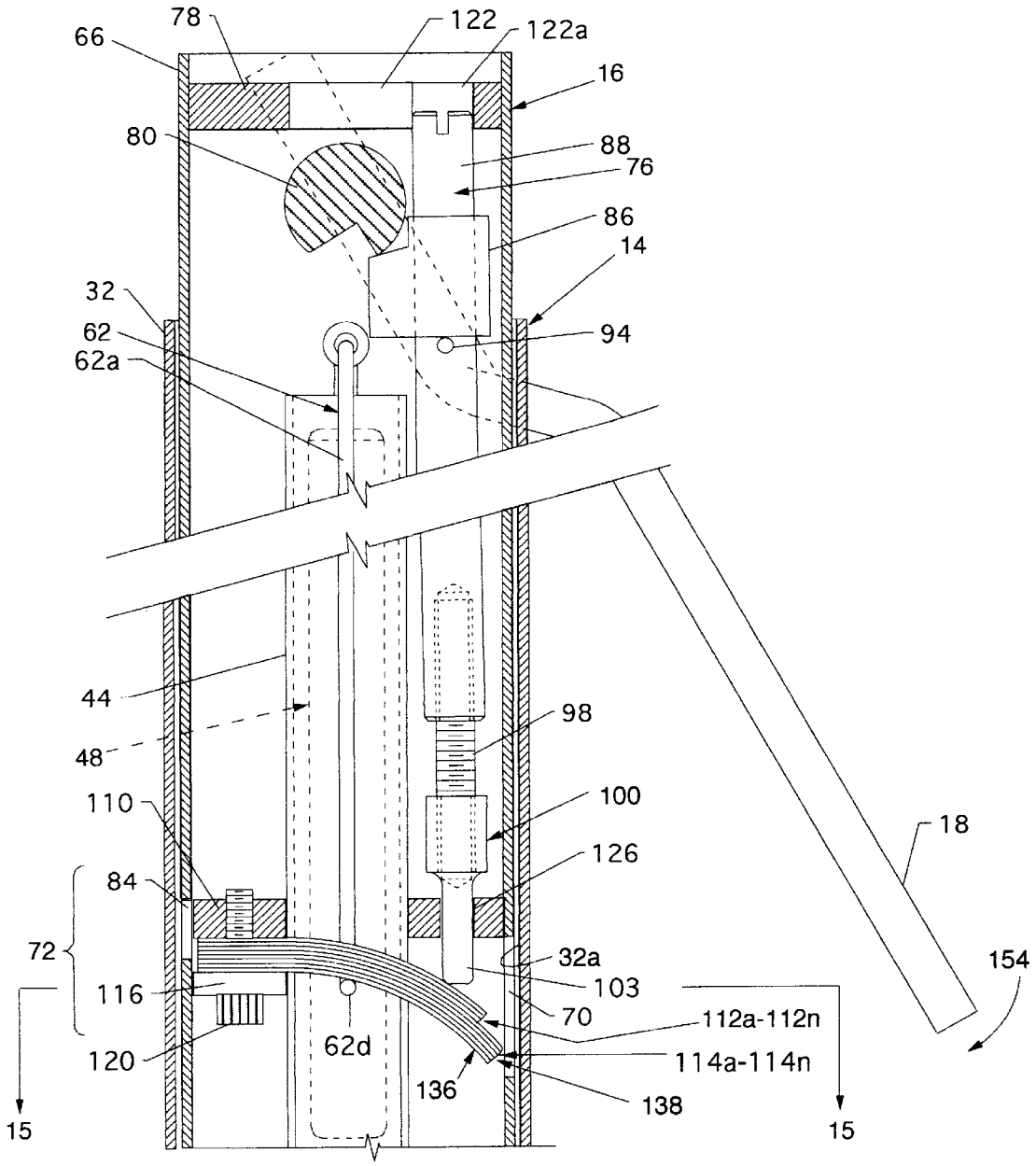
FIG. 14 illustrates a vertical cross section of the adjustable leg system illustrating a "disengaged" mode; and, FIG. 15 illustrates a cross sectional view along line 15—15 of FIG. 14.

FIG. 14 illustrates a vertical cross section of the adjustable leg system 10 showing the "disengaged" mode where the actuating handle 18 has been fully actuated to the fully down and unlocked position in a direction as shown by arrow 154 to cause bending and flexing of the circular flat springs 112*a*–112*n*, and also to cause corresponding bending and flexing of the tabbed circular flat springs 114*a*–114*n* away from the "engaged" position, as viewed in FIGS. 10 and 13, whereby the respective serrated edges 138 at the ends of the respective tabs 136 are positioned downwardly as well as inwardly toward the center of the interior and out of intimate forced contact with the interior surface 32*a*. This "disengage" mode disengages the three point lock process, and unlocks the inner tube assembly 16 from the outer tube assembly 14 to allow action of the gas spring 48 to assist in positioning the inner tube 16 assembly and its payload vertically with respect to the outer tube assembly 14. The gas spring 48 can have a predetermined load-bearing capacity. A relatively strong gas spring would allow the inner tube assembly and its payload to rise subsequent to entering the "disengage" mode, a nominal strength gas spring would allow easy vertical positioning with a minimum of manual applied force in either the up or down direction, and a weaker gas spring would allow for controlled descent positioning. Returning the actuating handle to the up and locked position, or parked position, releases almost all pressure applied to the pushrod assembly 76 by the circular flat springs 112*a*–112*n* and tabbed circular flat springs 114*a*–114*n* and allows the tabs 136 to once again re-engage the interior surface 32*a* of the outer tube 32 to once again re-establish three point locking, as previously described. The handle always seeks to return to the parked position. If the cam overshoots, the handle is parked downward and locks the spring plates. Controlled ascents or descents of the inner tube assembly and its payload can easily be controlled by toggling or intermittently operating the actuating handle 18.

Figure 15:
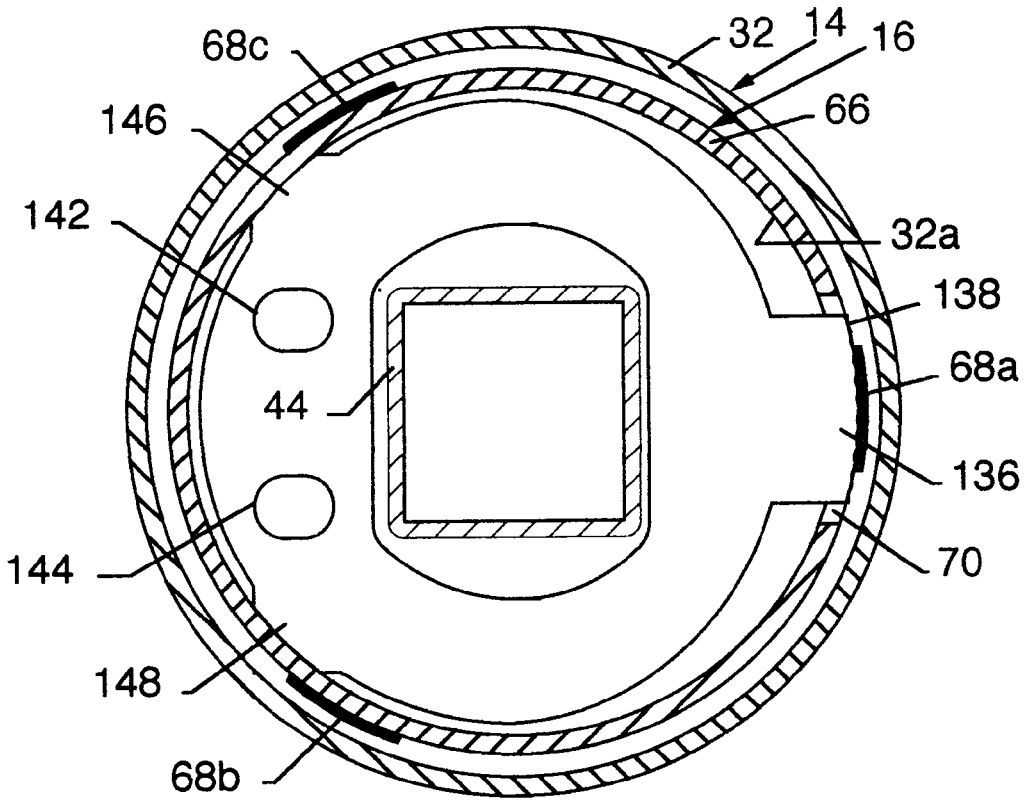

FIG. 15 illustrates a cross sectional view along line 15—15 of FIG. 14, where all numerals correspond to those elements previously described. Shown in particular in FIG. 15 is the "disengaged" mode where components of the outer tube assembly 14 are unlocked from components of the inner tube assembly 16 to discontinue utilization of the three point lock process. During this discontinued utilization of the three point triangulation lock process, force is no longer transmitted by the tabbed circular flat springs 114*a*–114*n* which normally would cause the inner tube assembly 16 to be lockingly forced against the glide members 68*b* and 68*c* in conjunction with intimate forced contact of the tabs 136 against interior surface 32*a* of the outer tube 32. The inner tube assembly 16, in general, is allowed to free float inside the outer tube assembly 14 while being under the influence of the gas spring 48 depending upon the direction of pressure by either the gas spring or the payload with or without assistance of the individual.

Various modifications can be made to the present invention without departing from the apparent scope hereof.

| ADJUSTABLE LEG SYSTEM PARTS LIST | |
|---|---|
| 10 | adjustable leg system |
| 12 | base support |
| 14 | outer tube assembly |
| 16 | inner tube assembly |
| 18 | actuating handle |
| 20 | mounting bracket |
| 22a–n | screws |
| 24a–n | holes |
| 25a–n | threaded holes |
| 26 | access hole |
| 28 | counterbalance assembly |
| 30 | circular plate |
| 30a–b | recesses |
| 32 | outer tube |
| 32a | interior surface |
| 34 | mounting stud |
| 36 | hole |
| 38 | washer |
| 40 | nut |
| 42 | circular base plate |
| 42a–b | holes |
| 44 | square tube |
| 46 | spacer rod |
| 48 | gas spring |
| 50 | cylinder |
| 52 | extension rod |
| 54 | stud |
| 56 | threaded surface |
| 58 | centering spacer |
| 60 | castellated nut |
| 62 | suspension yoke |
| 62a–b | legs |
| 62c | curved portion |
| 62d–e | tabs |
| 64 | screw-on pivot bracket |
| 66 | inner tube |
| 68a–c | glides |
| 70 | rectangular hole |
| 72 | plate/spring assembly |
| 74 | weld hole |
| 76 | pushrod assembly |
| 78 | mounting plate |
| 80 | cam |
| 80a | groove |
| 80b | pivot |
| 82 | hole |
| 84 | hole |
| 86 | mechanical pusher |
| 86a | bore |
| 86b | groove |
| 88 | upper rod |
| 90 | adjustment slot |
| 92 | threaded hole |
| 94 | stop pin |
| 96 | hole |
| 98 | threaded rod |
| 100 | lower rod |
| 102 | threaded hole |
| 103 | tip |
| 104 | flat surface |
| 106 | flat surface |
| 108 | impingement surface |
| 110 | mounting plate |
| 112a–n | circular flat springs |
| 114a–n | tabbed circular flat springs |
| 116 | clamping plate |

-continued

| ADJUSTABLE LEG SYSTEM PARTS LIST | |
|---|---|
| 118 | machine screw |
| 120 | machine screw |
| 122 | hole |
| 122a | slotted portion |
| 124 | welding tab |
| 126 | rectangular opening |
| 128 | square opening |
| 128a–b | notches |
| 130 | opening |
| 131 | threaded hole |
| 132 | threaded hole |
| 134 | body hole |
| 135 | body hole |
| 136 | tab |
| 138 | serrated edge |
| 140 | opening |
| 142 | elongated body hole |
| 144 | elongated body hole |
| 146 | spacer tab |
| 148 | spacer tab |
| 150 | spring clip |
| 152a–b | protuberances |
| 154 | direction arrow |
| 156 | direction arrow |

I claim:

1. An adjustable leg system for incorporation in pedestals, tables, chairs or stools, comprising:

a. an outer tube having an upper end, a lower end, an inner surface, and an outer surface;

b. an inner tube having an upper end, a lower end, an inner surface, an outer surface, and a hole extending therethrough from said inner surface to said outer surface, said inner tube being telescopically received within said outer tube and being adjustably movable along the length of said outer tube;

c. a locking mechanism for locking said inner tube to said outer tube at any location along the length of said outer tube, said locking mechanism being located within said inner tube and including a plate and a plurality of stacked flat springs, some of said stacked flat springs including a tab extending through said hole in said inner tube and frictionally engaging said inner surface of said outer tube, thereby arresting movement of said inner tube relative to said outer tube; and, d. an actuating mechanism for releasing said tabs from frictional engagement with said inner surface of said outer tube, whereby relative movement of said inner tube along the length of said outer tube is then permitted.

2. The adjustable leg system as defined in claim 1, wherein said plate of said locking mechanism has an upper surface, a lower surface, and a hole extending therethrough from said upper surface to said lower surface; wherein said plurality of stacked flat springs are located below said lower surface of said plate and extend across said hole in said plate; and wherein said actuating mechanism includes a pushrod assembly and an actuating handle, said pushrod assembly having a tip extending through said hole in said plate and contacting the uppermost one of said plurality of stacked flat springs, and said actuating handle having a cam which engages said pushrod assembly.

3. The adjustable leg system as defined in claim 2, wherein said pushrod assembly includes an upper rod and a lower rod, said lower rod being adjustably attached to said upper rod and including said tip which extends through said hole in said plate of said locking mechanism, and said upper rod carrying a pusher which engages said cam of said actuating handle.

4. The adjustable leg system as defined in claim 1, wherein said outer surface of said inner tube has three circumferentially spaced glides thereon extending from said lower end of said inner tube upwardly along said inner tube, two of said glides being positioned such that they come into frictional engagement with said inner surface of said outer tube when said tabs frictionally engage said inner surface of said outer tube, thereby establishing a three point locking engagement of said inner tube to said outer tube.

5. The adjustable leg system as defined in claim 1, and further comprising a counterbalance assembly positioned within said inner tube, said counterbalance assembly including a base plate positioned below said plate and plurality of stacked flat springs of said locking mechanism, a tube extending upwardly from said base plate and through said plate and plurality of stacked flat springs of said locking mechanism, a gas spring within said tube and having an upper end and a lower end, and a suspension yoke having a central portion attached to said upper end of said gas spring and two legs depending from said central portion, said two legs extending through said plate and plurality of stacked flat springs of said locking mechanism.

6. The adjustable leg system as defined in claim 5, wherein each of said two legs of said suspension yoke terminates in an outwardly extending tab, and said outwardly extending tabs are located beneath said plate and plurality of stacked flat springs of said locking mechanism.

7. The adjustable leg system as defined in claim 5, and further comprising a breakaway feature to prevent damage to components of the adjustable leg system by twisting, said breakaway feature including a plate with diametrically opposed recesses secured within said outer tube at said lower end thereof, and rounded protuberances carried by said base plate of said counterbalance assembly which engage in said recesses.

8. The adjustable leg system as defined in claim 5, and further comprising a mounting bracket attached to said inner tube at said upper end thereof.

9. The adjustable leg system as defined in claim 5, and further comprising a base support attached to said outer tube at said lower end thereof.

* * * * *